US008056286B2

(12) United States Patent
Gosling et al.

(10) Patent No.: US 8,056,286 B2
(45) Date of Patent: Nov. 15, 2011

(54) CONFIGURABLE SLIDING DOORS WITH REVERSIBLE HAND CONFIGURATIONS

(75) Inventors: Geoff Gosling, Calgary (CA); Mogens F. Smed, DeWinton (CA); Colin V Blehm, Calgary (CA); Steven M. van Beveren, Calgary (CA)

(73) Assignee: Dirtt Environmental Solutions Ltd., Calgary (CA)

( * ) Notice: Subject to any disclaimer, the term of this patent is extended or adjusted under 35 U.S.C. 154(b) by 777 days.

(21) Appl. No.: 12/135,019

(22) Filed: Jun. 6, 2008

(65) Prior Publication Data

US 2008/0302020 A1 Dec. 11, 2008

Related U.S. Application Data

(60) Provisional application No. 60/942,915, filed on Jun. 8, 2007.

(51) Int. Cl.
*E05D 13/00* (2006.01)

(52) U.S. Cl. ..... 49/409; 49/404; 49/425; 52/207; 52/243.1

(58) Field of Classification Search ..... 49/328, 49/404, 427, 506, 409, 410; 52/207, 243.1, 52/29

See application file for complete search history.

(56) References Cited

U.S. PATENT DOCUMENTS

| | | | | |
|---|---|---|---|---|
| 71,017 | A * | 11/1867 | Jenkins | 49/425 |
| 93,132 | A * | 7/1869 | Snyder | 292/261 |
| 882,950 | A * | 3/1908 | Merriman | 16/97 |
| 923,706 | A * | 6/1909 | Richey et al. | 16/95 R |
| 1,277,844 | A * | 9/1918 | Browne | 49/427 |
| 1,889,112 | A * | 11/1932 | Shoemaker | 16/97 |
| 3,416,183 | A * | 12/1968 | Martin | 16/105 |
| 4,077,160 | A * | 3/1978 | Stewart | 49/421 |
| 4,123,874 | A * | 11/1978 | Scott | 49/411 |
| 4,478,006 | A * | 10/1984 | Johnson, Jr. | 49/410 |
| 4,503,640 | A * | 3/1985 | Stern | 49/425 |
| 4,644,992 | A * | 2/1987 | Jerila | 160/213 |
| 5,119,872 | A * | 6/1992 | Engebretson | 160/381 |
| 5,287,655 | A * | 2/1994 | Harvey | 49/425 |
| 5,461,829 | A * | 10/1995 | Lehto et al. | 49/409 |
| 5,964,061 | A * | 10/1999 | Hughes et al. | 49/425 |
| 5,970,660 | A * | 10/1999 | Jacobs | 49/425 |
| 6,082,499 | A * | 7/2000 | O'Donnell | 187/324 |
| 6,487,752 | B1 * | 12/2002 | Mathews | 16/86 B |
| 6,581,332 | B1 * | 6/2003 | Kim | 49/358 |
| 6,584,664 | B2 * | 7/2003 | Hostetler et al. | 29/402.01 |
| 6,813,862 | B2 * | 11/2004 | Perich et al. | 49/425 |
| 2005/0000164 | A1 * | 1/2005 | Jacobs | 49/425 |
| 2007/0227074 | A1 * | 10/2007 | Frank | 49/409 |
| 2008/0010902 | A1 * | 1/2008 | Kim | 49/404 |

FOREIGN PATENT DOCUMENTS

JP 05113084 A * 5/1993

* cited by examiner

*Primary Examiner* — Jerry Redman
(74) *Attorney, Agent, or Firm* — Workman Nydegger

(57) ABSTRACT

A sliding door with reversible hand configurations can include a plurality of mounting locations along a top and a bottom edge thereof. The plurality of mounting locations can be configured to allow the sliding door to selectively hang and operate according to multiple orientations in order to satisfy site-specific handedness requirements. In one implementation, the sliding door includes a door frame and mounting hardware for selectively mounting the sliding door to a roller track affixed near the upper portion of a doorway.

20 Claims, 6 Drawing Sheets

CONFIGURABLE SLIDING DOORS WITH REVERSIBLE HAND CONFIGURATIONS

CROSS-REFERENCE TO RELATED APPLICATIONS

This application claims the benefit of U.S. Provisional Patent Application Ser. No. 60/942,915, filed Jun. 8, 2007, entitled "NON-HANDED CONFIGURABLE SLIDING DOORS," the entire contents of which are incorporated herein by reference.

BACKGROUND OF THE INVENTION

1. Technical Field

The present disclosure relates generally to door systems and components, such as door systems and components for use with movable walls.

2. Background and Relevant Art

Office space can be relatively expensive, not only due to the basic costs of the location and size of the office space, but also due to any construction needed to configure the office space in a particular way. An organization might purchase or rent a large open space in an office complex, and then subdivide or partition the open space into various offices, conference rooms, or cubicles, depending on the organization's needs and size constraints. Rather than having to find new office space and move as an organization's needs change, it is often necessary to have a convenient and efficient means to reconfigure the existing office space. Many organizations address their configuration and reconfiguration issues by dividing large, open office spaces into individual work areas using modular walls and partitions.

In particular, at least one advantage of modular systems is that they are relatively easy to configure. In addition, another advantage is that modular systems can be less expensive to set up, and can be reconfigured more easily than more permanently constructed office dividers. For example, a set of offices and a conference area can be carved out of a larger space in a relatively short period of time with the use of modular systems. If needs change, the organization can readily reconfigure the space.

In general, modular office partitions typically include a series of individual wall modules (and/or panels). The individual wall modules can either be free-standing or rigidly attached to one or more support structures. In addition, the wall modules are typically designed so that they can be assembled together to form a range of different configurations. In particular, a manufacturer or assembler can usually align and join the various wall modules together in almost any particular design, and then secure the design in place with any number of fasteners. These designs can include anything from large conference spaces to individual offices. A "finished" look is generally completed by adding gaskets or trim pieces in the joints between wall modules.

In addition, one will appreciate that many modular wall partitions will need to implement a closure apparatus, such as a door. Doors are manufactured for use in a variety of settings including both exterior as well as interior settings. Manufacturers fabricate doors to suit the end uses found in the various applications in which the doors are to be used. In turn, doors provide a convenient way to enter and exit structures or interior spaces as well as to selectively open and close entrances. The necessary configuration of a particular door is determined by the specific requirements of the site where the door is being installed. These requirements may dictate the direction a door is to be opened, the type of door to be used, the configuration of mounting hardware, and how the door is to be installed, among other aspects.

One particular use for doors is in conjunction with modular wall systems used to reconfigurably divide interior spaces. Of course, there are many types of doors from which to choose. In some cases, a manufacturer or designer will opt for a conventional swinging door, while in other cases, the manufacturer might opt for a sliding door configuration, whether for various aesthetic or space saving purposes. Regardless of the specific style or layout of the door, a manufacturer will typically need to fabricate a given door to suit a specific end-use found in the various applications in which the doors are to be used. One common consideration that will usually need to be taken into account is whether the door is a "left-handed" or "right-handed" door.

Manufacturers of sliding doors often fabricate doors with handles located on a selected side in order to allow the door to be opened in a desired direction. The door's hand is determined by the location of a door handle and the direction a door is opened. In general, the handedness of a door tends to be an important consideration since a door's hand may limit the situations in which the door may be used.

Specific situations where a sliding door is going to be installed dictate the hand required for a particular door. Those wishing to install a sliding door must know, prior to purchasing the door, what hand and other aspects of the door are required and purchase a sliding door that has been manufactured in accordance with the site specific requirements where the door is to be installed. One will appreciate, therefore, that, if the particular handedness of a door is incorrect for a particular layout, the assembler may need to replace the given door with another door that is configured for a different handedness. Specifically, if the hand of a door is wrong, the contractor must then switch the door for one with the correct hand.

One will appreciate, however, that precisely predicting whether a sliding door should be right-handed or left-handed in a given construction site may be in flux, even during installation of the doors and wall modules. This is particularly true of modular partition assemblies, where the partition layouts may change during installation, or even sometime later during a remodeling phase. Furthermore, changes to a project may require corresponding changes in the hand of a door and mistakes may result in the purchase of doors with the wrong handedness. All of the foregoing can delay and burden projects in which the installation of doors is necessary.

BRIEF SUMMARY OF THE INVENTION

Implementations of the present invention overcome one or more problems in the art with systems, methods, and apparatus configured to provide flexibility in the design and installation of door systems. In particular, implementations of the present invention allow for the reconfiguration of a single door regardless of the hand of the door for the given location. Furthermore, implementations of the present invention provide a manufacturer with the ability to produce one type of door that may be adapted for use at a number of given locations, and thereby minimize the number of components and materials used.

For example, a sliding door system that can be readily reconfigured on site for a plurality of different handedness requirements can include a horizontally symmetrical door frame having a plurality of different mounting locations. The plurality of mounting locations is configured to allow the sliding door to be selectively installed according to a plurality of orientations to reverse the handedness configuration of the sliding door. The system can also include a door pull coupled to the door frame. In this case, the door pull is configured for opening and closing the sliding door. In addition, the system can include mounting hardware comprising a roller mount assembly and a roller track assembly. A manufacturer can configure the mounting hardware and roller track assembly to be selectively coupled to the door frame in different orientations to reverse the handedness of the sliding door.

Similarly, a method for reversing the handedness configuration of a sliding door based on the orientation of the sliding door is provided. In particular, an assembler can identify that a sliding door in a doorway has a handedness configuration that needs to be reversed. The assembler can then remove the mounting hardware of the sliding door from a roller track affixed to the upper portion of a doorway. Similarly, the assembler can detach the mounting hardware from the door frame of the sliding door. As a result, by reorienting the door frame in a vertical or horizontal manner, the assembler can reverse the handedness configuration of the sliding door with respect to the doorway. Thereafter, the assembler can reattach the mounting hardware to the door frame and insert the mounting hardware into the roller track, wherein the sliding door is operable in the reverse handedness configuration.

In addition, a sliding door system that can be readily reconfigured on site for a plurality of different handedness requirements based on a vertical or horizontal orientation of the sliding door can include a doorway with a sliding connector means affixed thereto. The sliding connector means can allow a doorway closure means to slide open and closed with respect to the doorway. A reversible mounting means can reversibly mount the doorway closure means to the sliding connector means in a left or right handedness configuration with respect to the doorway even after the doorway closure means has been installed in an initial handedness configuration.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to provide flexibility in the design and installation of door systems. In particular, implementations of the present invention allow for the reconfiguration of a single door regardless of the hand of the door for the given location. Furthermore, implementations of the present invention provide a manufacturer with the ability to produce one type of door that may be adapted for use at a number of given locations, and thereby minimize the number of components and materials used.

Accordingly, and as will be understood more fully herein, an assembler can purchase a door of the present invention without regard for handedness restrictions. Specifically, when needed, the assembler can then configure the door, as necessary, to satisfy the specific handedness requirements of a given location. Thereafter, the assembler can even reconfigure the door if a different handedness is desired or required. Furthermore, the assembler can reuse the door at different locations with different handedness requirements by easily reconfiguring the door to satisfy the requirements at any given location. As a result, the door system of the present invention can also reduce the number of doors an assembler need keep in inventory.

Implementations of the present invention can be especially beneficial in the construction of modular wall systems, where the wall partition layouts can change during installation, or even sometime later during a remodeling phase. If changes to a project require corresponding changes in the handedness of a door or if a particular handedness configuration for the door is incorrect for a particular layout, the assembler can easily reconfigure the same door to satisfy the different handedness requirements. Thus, implementations of the present invention provide greater flexibility and efficiency in door systems.

Figure 1:
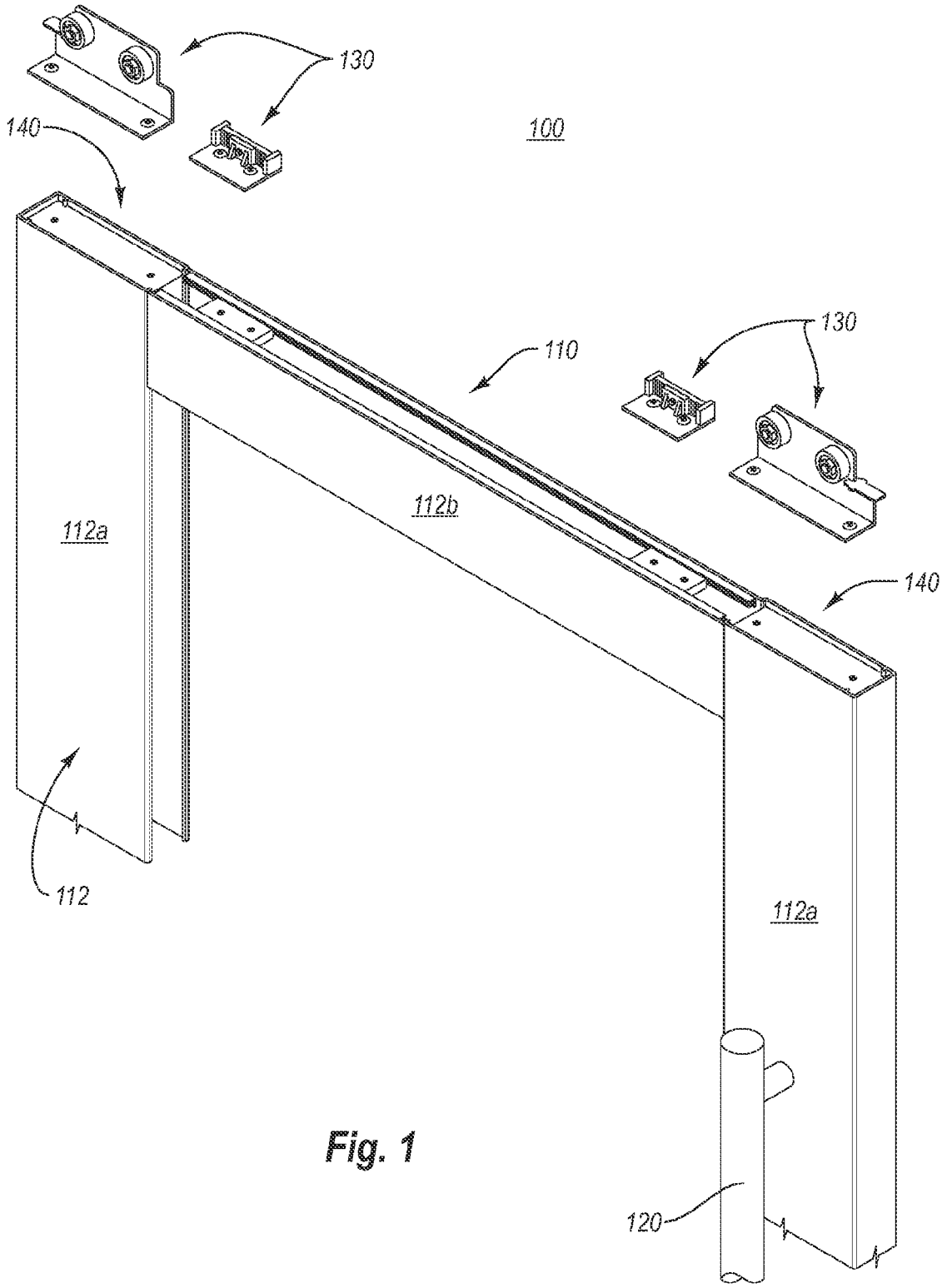
FIG. 1 illustrates a partial perspective view of a sliding door and corresponding hardware in accordance with an implementation of the present invention.

Referring now to the Figures, FIG. 1 illustrates several components of the reconfigurable door system 100 in accordance with an implementation of the present invention. As shown in FIG. 1, for example, the system 100 includes a doorway closure means and reversible mounting means. As illustrated, the doorway closure means can include a sliding door 110 and the reversible mounting means can comprise separate mounting hardware 130. As understood more fully herein, these and other components/parts can be used to create or install a door with virtually any handedness configuration.

As used herein, the "hand" of a door generally relates to the direction and manner in which a particular door opens. For example, a user facing a door, and pulling a door pull/handle on the right side of the door, and pulling the door from right to left (swinging or sliding), would be facing a right-handed door configuration. By contrast, a user facing a door and pulling a door pull/handle on the left side of the door, and pulling the door from left to right (swinging or sliding), would be facing a left-handed door configuration. Changing the hand of the door in accordance with implementations of the present invention, therefore, can allow an assembler to easily configure the given door for use at a variety of locations.

To these and other ends, FIG. 1 illustrates that in at least one implementation of the present invention, the doorway closure means can also comprise a door frame 112 comprising a plurality of spaced-apart vertical members 112*a* coupled with at least one horizontal member 112*b*. In at least one implementation, the door frame 112 can be horizontally and/or vertically symmetrical so as to facilitate operation of the door 110 according to multiple configurations and orientations. A manufacturer can form the vertical 112*a* and/or horizontal 112*b* members of the door frame 112 using metallic materials, including extruded metallic materials, such as extruded aluminum. One will appreciate, however, that the door frame 112 can be manufactured using any number of other materials including wood, glass, plastic and the like. In an additional implementation, the door frame 112 can include a glass panel (not shown) coupled to the vertical 112*a* and horizontal 112*b* members.

FIG. 1 further illustrates a handle or door pull 120 coupled to the door frame 112 to facilitate opening and closing the door 110. As is illustrated, for example, an assembler can couple a door pull 120 to a vertical member 112*a* of the door frame 112. While FIG. 1 illustrates the use of a single door pull 120 coupled to one side of the door 110, it will be appreciated that an assembler or manufacturer can couple multiple door pulls 120 to the door 110. For example, a manufacturer can configure the door 110 to include similar door pulls 120 on opposite sides of the vertical member 112*a*, such that a user can operate a door pull 120 to open the door 110 regardless of the side of the door 110 on which a user is located.

In situations where a single door pull 120 is used, the side of the door 110 to which the door pull 120 is attached will sometimes be referred to herein for reference purposes only as the "door-pull side" of the door 110. For further reference purposes, the side of the door 110 facing the modular wall to which the door 110 is attached may be referred to herein as the "wall side" of the door 110, while the side facing away from the modular wall may be referred to herein as the "non-wall side" of the door 110.

In addition to the door pull 120, FIG. 1 illustrates that the door 110 can also include a plurality of mounting locations 140 along the top edge thereof. A manufacturer can configure the mounting locations 140 to receive separate mounting hardware 130 for mounting the door 110 to a doorway where the door 110 is going to be employed. Although not shown in FIG. 1, one will appreciate that the manufacturer can also include similar mounting locations 140 along the bottom edge of the door 110, such that an assembler can couple the separate mounting hardware 130 to the top edge or alternatively to the bottom edge of the door 110, as desired, for different handedness configurations. As a result, the door 110 may be used in a variety of configurations wherein an assembler can horizontally or vertically rotate the door 110 as desired for different handedness configurations. Accordingly, the terms "top" and "bottom" are used for ease of reference only.

FIG. 1 further illustrates reversible mounting means, which can include separate mounting hardware 130, and which an assembler can attach to the mounting locations 140 of the door frame 112 and use to mount the door 110 at a desired location. In one implementation of the present invention, an assembler can mount the door 110 to a doorway by inserting the mounting hardware 130 into a sliding connector means attached above the doorway, thereby allowing a user to slide the door 110 open and closed. In one implementation, the sliding connector means includes a roller track assembly (e.g., 150, FIG. 3). A manufacturer can configure the separate mounting hardware 130 so that an assembler can selectively couple the mounting hardware 130 to the mounting locations 140 in accordance with multiple configurations, which thus facilitates reconfiguration of the handedness of the door 110. For example, in at least one implementation of the present invention, the manufacturer can configure the mounting hardware 130 to universally interface with (and couple to) any of the mounting locations 140 of the door 110, regardless of the mounting location 140 or the direction the mounting hardware 130 faces, whether towards the front or back of the door. Of course, one will appreciate that "front" and "back" are used for reference purposes only. For example, a door 110 can be readily reconfigured such that the front becomes the back and vice versa.

Figure 2:
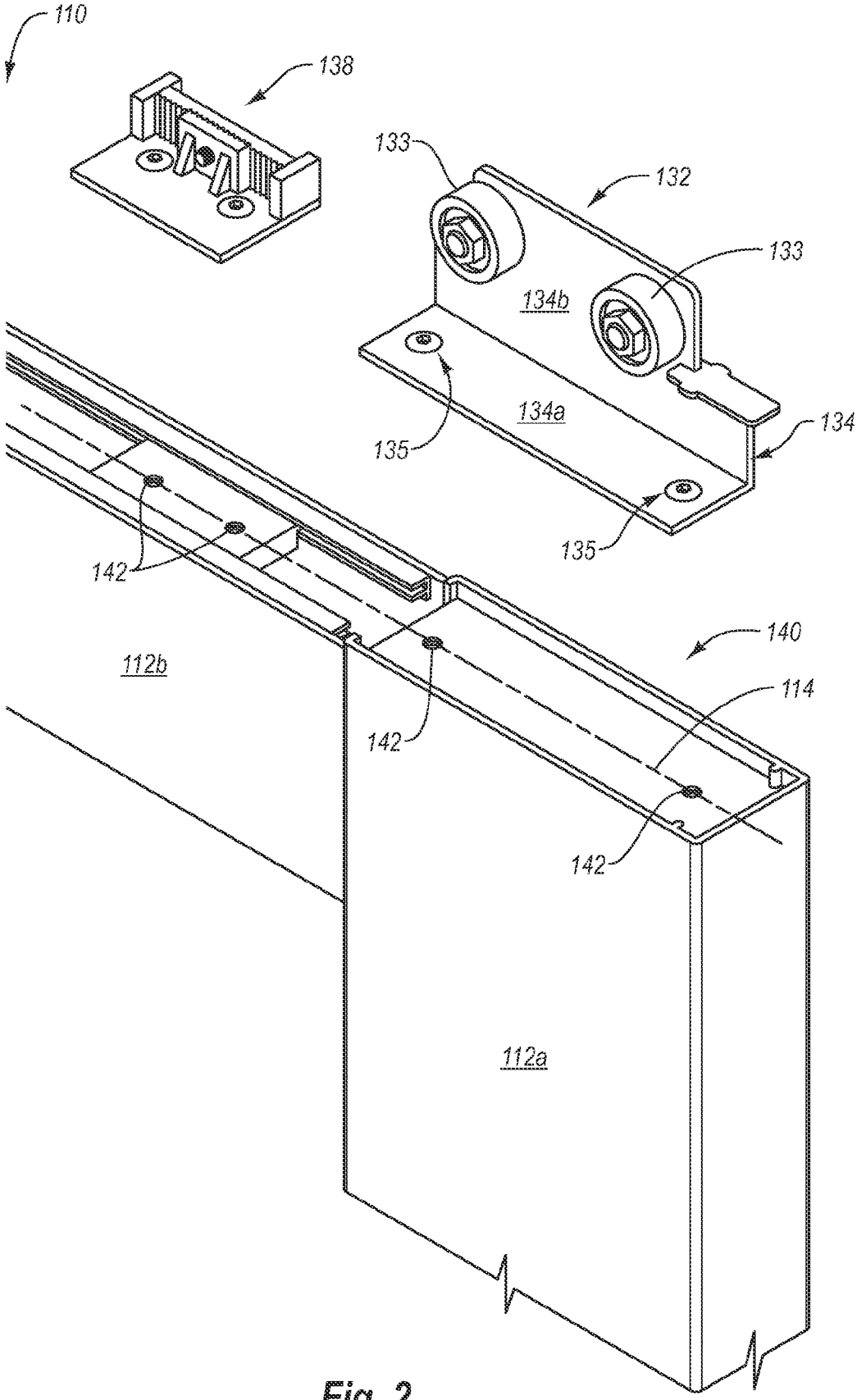
FIG. 2 illustrates a partial perspective view of the sliding door of FIG. 1, and further illustrates the orientation of the mounting hardware in relation to the door.

FIG. 2 illustrates a partial perspective view of the system 100 illustrated in FIG. 1 in more detail. As illustrated in FIG. 2, the separate mounting hardware 130 can include a roller mount assembly 132 and a slowdown block 138. The roller mount assembly 132 can interface with a roller track (e.g., 150, FIG. 3) such that a user can slide the door 110 open and closed. The slowdown block 138 can regulate the speed at which the door 110 slides open and closed for safety purposes and to prevent damage to the components of the door system 100. The roller mount assembly 132 and slowdown block 138 can mount to a mounting location 140, in this case, on the right side of the top of the door 110. Of course, one will appreciate that the terms "right" and "top" are used for ease of reference only, and any reference to "right" or "left" with respect to any particular mounting location will be understood as being relative to the intended handedness of any given door. For example, though not illustrated, the left top side, and both the bottom left and bottom right sides of the door 110 can also include mounting locations 140 defined therein.

In particular, the mounting location 140 can include a plurality of mounting holes 142 defined therein. In at least one implementation, the mounting holes 142 of the multiple mounting locations 140 can be substantially similar. As illustrated in FIG. 2, the mounting holes 142 can be generally centered relative to the minor axis 114 of the door 110, which can also be referred to as the thickness of the door 110. In a further implementation, the mounting locations 140 can be configured to be symmetric about the minor axis 114 of the door 110 so as to facilitate reversibly mounting the separate mounting hardware 130 to the mounting locations 140.

In any event, as illustrated in FIG. 2, the roller mount assembly 132 and slowdown block 138 can be secured to the door frame 112 by way of the mounting holes 142. In particular, the roller mount assembly 132 includes a bracket 134. FIG. 2 further shows that the bracket 134 can include a base portion 134*a* and an offset vertical portion 134*b*. The base portion 134*a* of the bracket 134 can also include holes 135 defined therein to allow the bracket 134 to be mounted to the corresponding mounting holes 142 in the mounting location 140. By way of explanation, the various parts of the roller mount assembly 132 and slowdown block 138 can be formed using metallic materials. For example, in at least one implementation, a manufacturer can form the bracket 134 from sheet metal of any type and can form the slowdown block 138 using a zinc alloy.

As FIG. 2 further illustrates, in addition to a bracket 134, the roller mount assembly 132 can also include one or more rollers 133. A manufacturer can configure the rollers 133 to interface with and roll along a roller track (not shown) to slide the door 110 open and closed. While FIG. 2 illustrates the use of rollers 133, one will appreciate that a manufacturer may use other means for allowing the door 110 to slide open and closed. In at least one implementation of the present invention, for example, a manufacturer may include bearings to facilitate the sliding of the door 110.

Figure 3:
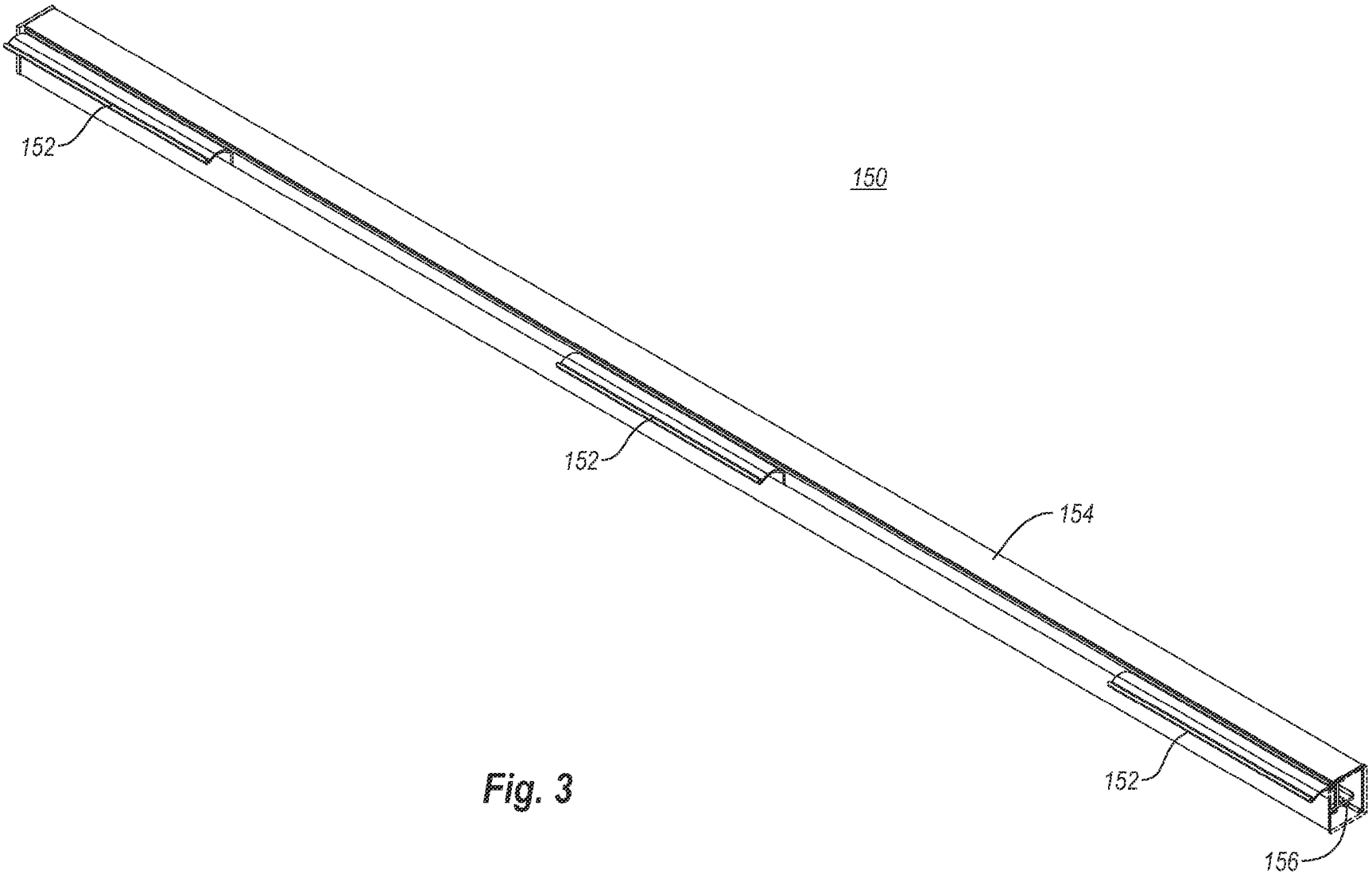
FIG. 3 illustrates a doorframe header that can be used in accordance with an implementation of the present invention.

FIG. 3 illustrates an example of a roller track configured to interface with the rollers 133 of the roller mount assembly 132. In particular, FIG. 3 illustrates a roller track assembly 150 for use in at least one implementation of the present invention. As is illustrated, the roller track assembly 150 can include a plurality of brackets 152 configured for coupling the roller track assembly 150 to a modular wall or doorway. In at least one implementation, the brackets 152 are removable and their location along the roller track assembly 150 is adjustable. In particular, an assembler can move and/or remove the brackets 152 in order to configure the roller track assembly 150 for use in a variety of different handedness configurations and with a variety of different modular wall and doorway configurations. Although FIG. 3 illustrates the use of brackets 152, one will appreciate that a manufacturer can configure the roller track assembly 150 to include any available means for securing the roller track assembly 150 to a modular wall or doorway.

As further illustrated in FIG. 3, the roller track assembly 150 can include a roller track 156 configured to receive rollers or other means for sliding or rolling along the length of the roller track assembly 150. In addition, FIG. 3 shows that the roller track assembly 150 can include a trim cap 154 configured to cover and protect the roller track 156, and improve the aesthetics of the roller track assembly 150.

Figure 4:
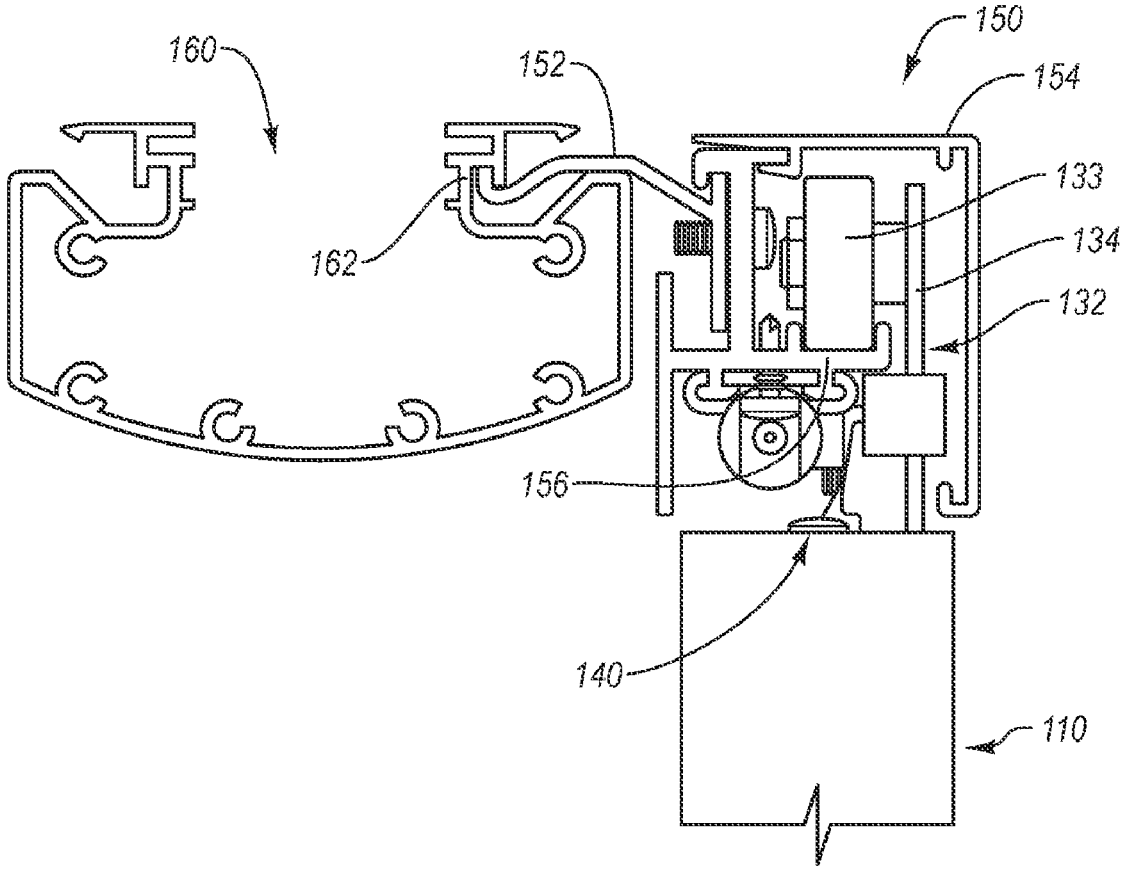
FIG. 4 illustrates a cross-sectional view of a roller track assembly that can be used according to at least one implementation of the present invention.

FIG. 4 illustrates a more detailed representation of a roller track assembly 150. In particular, FIG. 4 shows a partial cross-sectional view of the roller track assembly 150, a doorway header 160, a roller mount assembly 132, and a door 110, and how the components interact. In particular, FIG. 4 illustrates an implementation in which an assembler has coupled the door 110 to the roller mount assembly 132, and inserted the roller mount assembly 132 into the roller track assembly 150. As shown, this assembly allows the rollers 133 to slide along the roller track 156 in order to open and close the door 110.

FIG. 4 also shows that the roller track assembly 150 is in turn coupled to the doorway header 160. Specifically, an assembler can couple the doorway header 160 to a modular wall to span the top of a doorway. Along these lines, FIG. 4 shows that the doorway header 160 can include a channel 162, or other connection details, configured to receive the brackets 152 of the roller track assembly 150. In turn, an assembler can fasten the brackets 152 to the roller track 156 in a desired configuration. Accordingly, a manufacturer or assembler can couple the roller track assembly 150 to the doorway header 160. The roller track assembly 150 can also overlap the doorway (to the left or the right) in order to allow a door 110 to open to the left or the right of the doorway. As such, a manufacturer can further configure the roller track assembly 150 to be coupled to the portion of the adjacent modular wall overlapped by the roller track assembly 150.

Once the roller track assembly 150 is coupled to the doorway header 160, an assembler can insert the roller mount assembly 132 into the roller track assembly 150, such that the rollers 133 interface with the roller track 156. As a result, the rollers 133 can roll along the length of the roller track 156, thereby allowing the door 110 to slide relative to the doorway. In one implementation, the assembler may then install a trim cap 154, which can provide an aesthetically pleasing and protective cover for the components of the roller track assembly 150 and the roller mount assembly 132. In one implementation, an assembler may also install end caps (not shown) at the opposite ends of the roller track assembly 150.

With continued reference to FIGS. 3 and 4, one will appreciate that as a user opens a door 110, a substantial portion of the door 110 can travel beyond a doorway. In one implementation, the travel of the door 110 relative to the doorway can be controlled by the configuration of the roller track assembly 150. For example, FIGS. 3 and 4 show that the roller track 156 of the roller track assembly 150 can be less than double the width of a doorway, as a portion of the door 110 can still overlap the doorway when the door 110 is in the opened position.

Accordingly, an assembler can couple the roller track assembly 150 to a doorway, such that a first portion of the roller track assembly 150 is positioned directly over the doorway, and the remaining portion is positioned to the left or right of the doorway, depending on the direction of travel desired for the door 110. Specifically, an assembler can install the roller track assembly 150 to overlap to the right of the doorway if desiring that the door 110 open to the right, such as with a left-handed door configuration. Similarly, an assembler can install the roller track assembly 150 to overlap to the left of the doorway if desiring that the door 110 open to the left, such as with a right-handed door configuration. As such, the reconfigurable nature of the roller track assembly 150 furthers the reconfigurable capability of the system 100 by allowing the door 110 to be slid opened (or shut) in either direction, as is necessary or desired, for different handedness configurations and different locations.

Figure 5C:
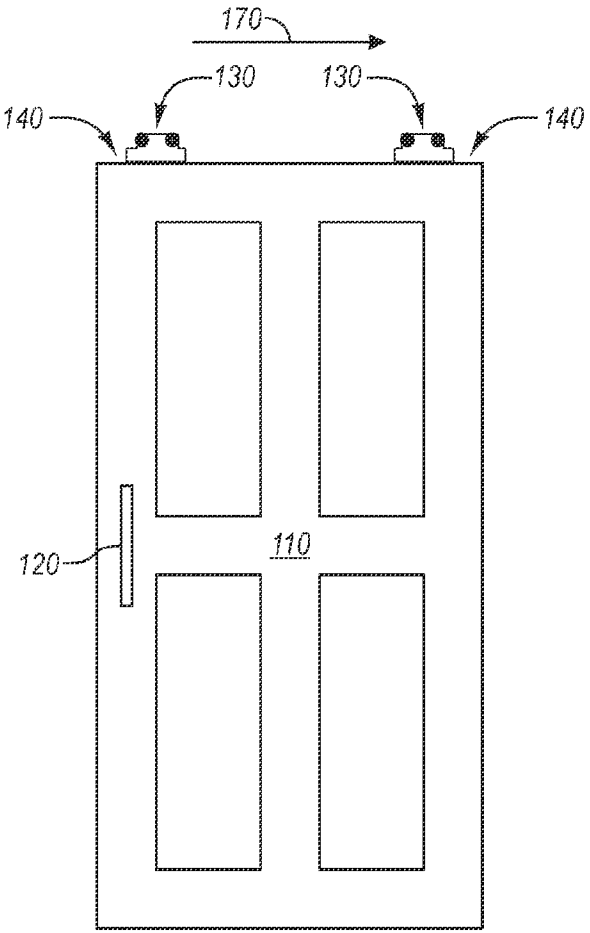
FIG. 5C illustrates a left handed reconfiguration of the door shown in FIG. 5A, in accordance with an implementation of the present invention.
Figure 5B:
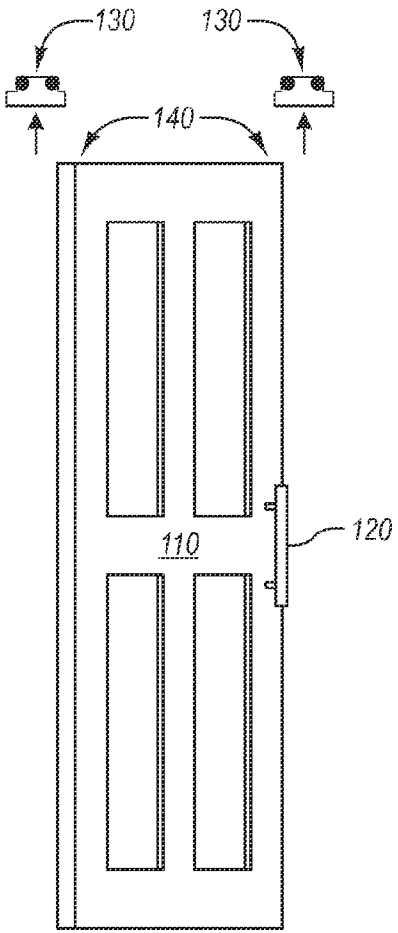
FIG. 5B illustrates the horizontal rotation of the door of FIG. 5A.
Figure 5A:
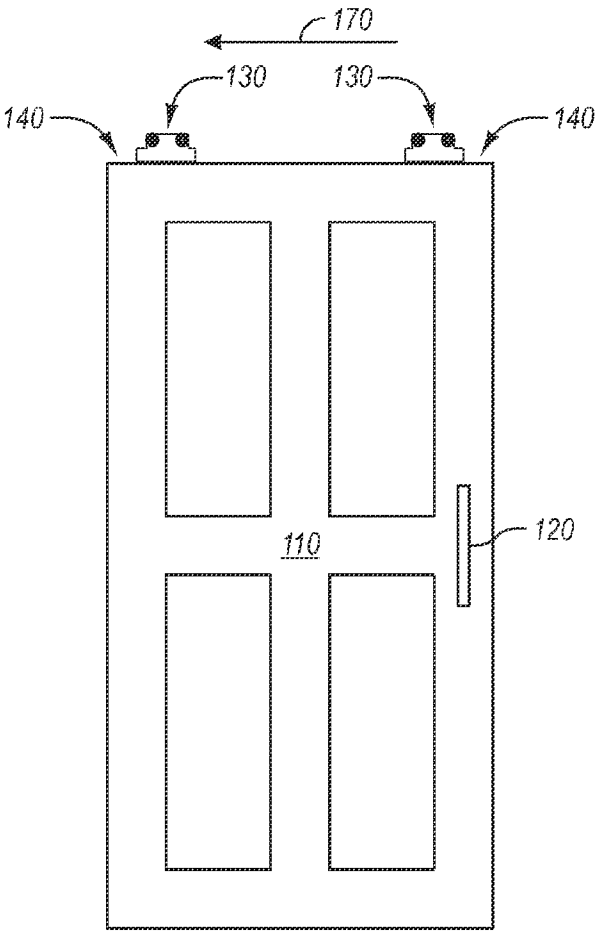
FIG. 5A illustrates right handed configuration of a door that is assembled in accordance with an implementation of the present invention.

FIGS. 5A-5C illustrate further examples of how an assembler can reconfigure the handedness configuration of the sliding door 110, in accordance with an implementation of the present invention. In particular, FIGS. 5A-5C illustrate the same sliding door 110 configured to have opposite handedness configurations. For example, FIG. 5A illustrates the door 110 having a right handed configuration, with the door pull 120 located on the right side of the door 110, and being configured to slide open to the left as shown by the sliding direction 170. As previously introduced, the door 110 includes mounting locations 140 along the top edge of the door 110 to which an assembler can mount the separate mounting hardware 130, such as a roller mount assembly (e.g., 132, FIG. 1). In turn, the assembler can insert the mounting hardware 130 into a roller track assembly (e.g., 150, FIG. 3) to allow the door to slide open and closed. In the configuration illustrated in FIG. 5A, the assembler would install the roller track assembly to overlap a doorway to the left to allow the door 110 in its right-handed configuration to slide open to the left as indicated by the sliding direction 170.

If desired, the assembler can later reconfigure the door 110 to have a left-handed configuration, such as illustrated in FIG. 5C. In at least one example, as illustrated by FIG. 5B, in order to change the hand of the door 110, an assembler can remove the separate mounting hardware 130 from the roller track assembly (e.g., 150, FIG. 3). The assembler can then remove the separate mounting hardware 130 from the door 110. Thereafter, the assembler can horizontally rotate the door 110 180 degrees such that the front of the door 110 becomes the back and vice versa, and such that the door pull 120 is located on the opposite side as illustrated in FIG. 5C.

FIG. 5C further illustrates that the assembler can then remount the separate mounting hardware 130 to the mounting locations 140 on the top of the door 110. The assembler can also remove the roller track assembly (e.g., 150, FIG. 3) which was previously coupled to the doorway overlapping to the left and recouple the roller track assembly to the doorway overlapping to the right such that the door 110 can slide open to the right as illustrated by the slide direction 170. The assembler can further insert the separate mounting hardware 130 back into the roller track assembly 150 to complete the reconfiguration of the handedness of the door 110. Thus, FIG. 5C illustrates the result in which the door 110 has a left handed configuration and is configured to slide open to the right. Accordingly, the configuration of the components of the system 100 allows the hand of the door 110 to be reconfigured from one side to the other in a convenient and rapid fashion.

Although FIGS. 5A-5C illustrate one method of reconfiguring a door in accordance with an implementation of the present invention, one will appreciate that an assembler can reconfigure the door in a number of ways. For example, while Figures 5A-5C illustrate a reconfiguration of the door 110 using a horizontal 180 degree rotation, an assembler can also reconfigure the hand of the door 110 using vertical rotation, or using a combination of horizontal and vertical rotation as necessary to obtain the configuration desired for a certain location.

Figure 6A:
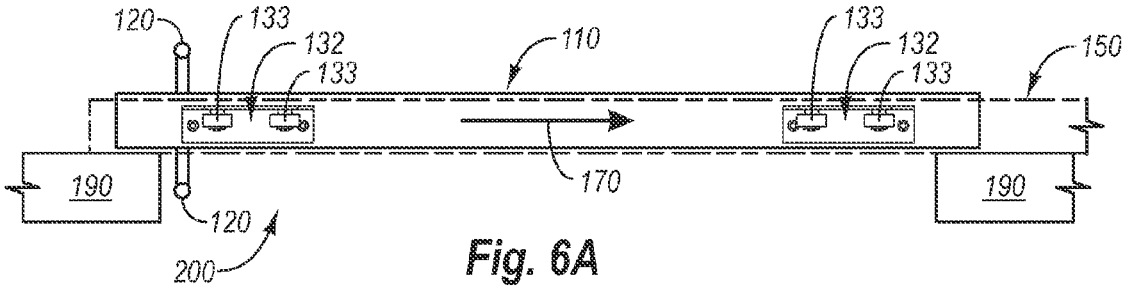
FIG. 6A illustrates a left handed configuration of a sliding door in accordance with an implementation of the present invention.

For example, FIGS. 6A-6D illustrate multiple reconfigurations of a sliding door 110 coupled to a doorway 200 of a modular wall 190. FIG. 6A illustrates the door 110 having a left handed configuration from the perspective of a user on the wall side of the door 110. Mounting hardware comprising a roller mount assembly 132, attaches to the door 110 with the rollers 133 facing the wall side of the door 110 so as to interface with the roller track assembly 150 (only the outline of which is shown) and allow the door to slide open to the right as shown by the slide direction 170. Of course, one will appreciate that the terms "right" and "left" are used for ease of reference only, and any reference to "right" or "left" with respect to a sliding direction 170 will be understood as being relative to the intended handedness of any given door from the perspective of a user on the wall side of the door 110.

Figure 6B:
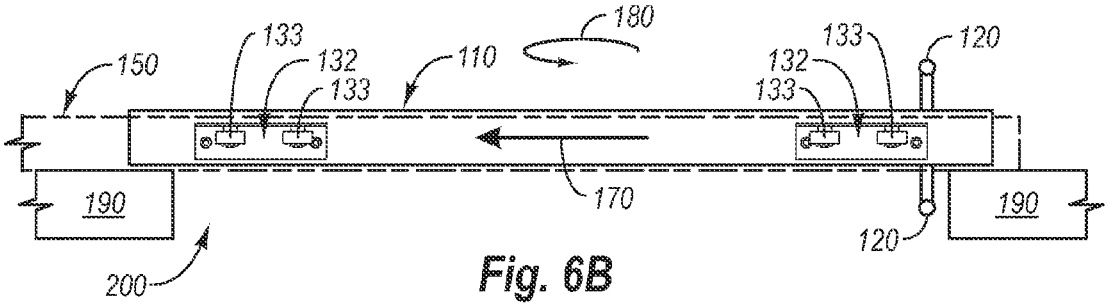
FIG. 6B illustrates a right handed configuration of the door of FIG. 6A.

An assembler can reconfigure the door 110 from a left handed configuration as illustrated in FIG. 6A to a right handed configuration as illustrated in FIG. 6B. To do so, the assembler can remove the roller mount assembly 132 from the roller track assembly 150 and detach the roller mount assembly 132 from the door 110. The assembler can then vertically rotate the door 110, as illustrated by the rotation direction 180, so as to locate the door pull 120 on the right side of the door 110 as illustrated in FIG. 6B. By vertically rotating the door 110, the top of the door 110 illustrated in FIG. 6A becomes the bottom of the door 110 and vice versa. In order to facilitate reconfiguration of the door 110 through vertical rotation, the door can include mounting locations (e.g., 140, FIG. 1) on both the top and the bottom edges of the door 110.

As FIG. 6B further illustrates, the assembler can then reattach the roller mount assembly 132 to the door 110 and insert the roller mount assembly 132 back into the roller track assembly 150. To facilitate sliding the door 110 to the left as indicated by the slide direction 170, the assembler can remove the roller track assembly 150 and recouple the roller track assembly 150 to the doorway 200 so as to overlap the doorway 200 to the left.

Figure 6C:
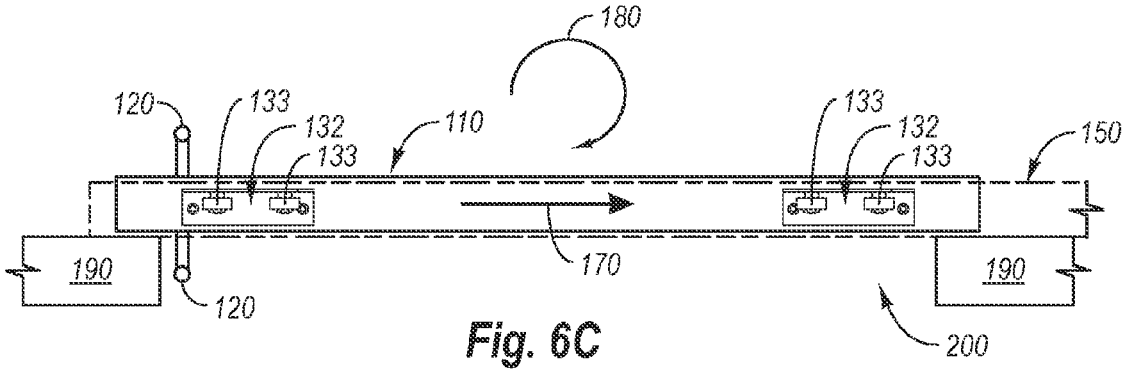
FIG. 6C illustrates an alternative left handed configuration of the door of FIG. 6A.

As illustrated by FIG. 6C, an assembler can then reconfigure the door 110 to have an alternative left handed configuration. To do so, the assembler can remove the roller mount assembly 132 from the roller track assembly 150 and detach the roller mount assembly 132 from the door 110. The assembler can then horizontally rotate the door 110, as illustrated by the rotation direction 180, so as to locate the door pull 120 on the left side of the door 110 as illustrated in FIG. 6C. Unlike the vertical rotation discussed above, by horizontally rotating the door 110, the top edge of the door 110 illustrated in FIG. 6B remains the top edge of the door 110 illustrated in FIG. 6C.

As FIG. 6C further illustrates, the assembler can then reattach the roller mount assembly 132 to the door 110 and insert the roller mount assembly 132 back into the roller track assembly 150. To facilitate sliding the door 110 to the right as indicated by the slide direction 170, the assembler can remove the roller track assembly 150 and recouple the roller track assembly 150 to the doorway 200 so as to overlap the doorway 200 to the right.

Figure 6D:
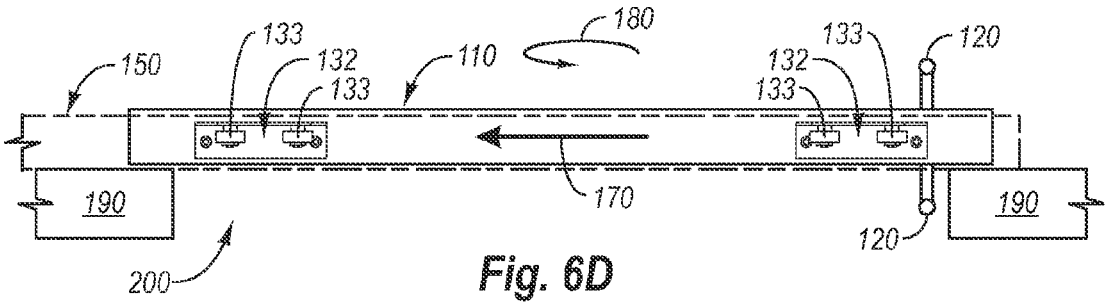
FIG. 6D illustrates an alternative right handed configuration of the door of FIG. 6A.

As illustrated in FIG. 6D, an assembler can reconfigure the door 110 from the left handed configuration illustrated in FIG. 6C to a right handed configuration as illustrated in FIG. 6D. To do so, the assembler can remove the roller mount assembly 132 from the roller track assembly 150 and detach the roller mount assembly 132 from the door 110. The assembler can then vertically rotate the door 110, as illustrated by the rotation direction 180, so as to locate the door pull 120 on the right side of the door 110 as illustrated in FIG. 6D. By vertically rotating the door 110, the top of the door 110 illustrated in FIG. 6C becomes the bottom of the door and vice versa.

As FIG. 6D further illustrates, the assembler can then reattach the roller mount assembly 132 to the door 110 and insert the roller mount assembly 132 back into the roller track assembly 150. To facilitate sliding the door 110 to the left as indicated by the slide direction 170, the assembler can remove the roller track assembly 150 and recouple the roller track assembly 150 to the doorway 200 so as to overlap the doorway 200 to the left.

Of course, one will appreciate that although the hand of the door 110 has been described as being changed after the door 110 has been mounted to a doorway 200, the hand of the door 110 can also be configured from one side to the other as desired prior to mounting the door 110.

In addition to the foregoing, implementations of the present invention can also be described in terms of one or more steps in a method of accomplishing a particular result. For example, at least one implementation of the present invention comprises a method for reversing the handedness configuration of a sliding door based on a vertical or horizontal orientation of the sliding door. This method is described more fully below.

For example, at least one method in accordance with the present invention can comprise an act of determining that a door's handedness configuration needs to be reversed. This act can include identifying a door in a doorway having a handedness configuration that needs to be reversed. For example, an assembler determines that a doorway is configured with a roller track assembly 150 in one position that corresponds with a particular door handedness configuration, but a different door handedness configuration is required for the doorway. Alternatively, a manufacturer can desire to switch the door handedness configuration of a sliding door 110 already in place in a doorway.

The method can also comprise an act of taking apart the existing components of the doorway. This act can include removing the mounting hardware of a sliding door from a roller track affixed to the upper portion of a doorway. For example, an assembler can remove the sliding door 110 from the doorway by removing the mounting hardware 130 of the sliding door 110 from the roller track assembly 150.

In addition, the method can comprise an act of removing the mounting hardware from the sliding door. This act can include detaching the mounting hardware from the door. For example, an assembler can remove the mounting hardware 130 from the mounting locations 140 of the sliding door 110.

Furthermore, the method can comprise an act of reorienting the sliding door to reconfigure its handedness configuration. This act can include reorienting the door in a vertical or horizontal manner to reverse the handedness configuration of the door with respect to the doorway. For example, an assembler can horizontally rotate the sliding door 110 with respect to the doorway. In particular, the assembler can rotate the sliding door 110, thereby locating the door pull 120 on the opposite side of the sliding door 110 with respect to the doorway.

Still further, the method can comprise an act of remounting the sliding door according to the reconfigured handedness configuration. This act can include reattaching the mounting hardware to the door and inserting the mounting hardware into the roller track, wherein the sliding door is operable in the reverse handedness configuration. For example, an assembler can reattach the mounting hardware 130 to the mounting locations 140 of the sliding door 110 and reinsert the mounting hardware 130 into the roller track assembly such that the sliding door 110 can operate according to the reversed handedness configuration.

Accordingly, FIGS. 1-6D, and the corresponding text, illustrate and describe a number of schematics, components, and mechanisms of a reconfigurable door and door mounting system. In particular, as illustrated herein, implementations of the present invention allow for the reconfiguration of a single door to satisfy multiple handedness configurations. The components described herein allow a manufacturer to produce one type of door that may be adapted for use at a number of given locations, thereby minimizing the number of components and materials used.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In an architectural design environment that includes one or more modular wall systems with one or more doorways, at least one of the doorways having an upper track affixed thereto, a sliding door that can be readily reconfigured after installation in a doorway so that the sliding door can be changed from a left-handed to a right-handed opening and vice versa, the sliding door comprising:

a door frame having first and second vertical members joined at the top by a first horizontal member and joined at the bottom by a second horizontal member, the first and second vertical members and the first horizontal member together defining a top edge of the door frame which includes a plurality of mounting locations on said top edge;

a door pull connected to one of said first or second vertical members so as to define either a left-handed or right-handed door when installed in said doorway;

mounting hardware attached to said mounting locations on said top edge of the door frame in a manner that leaves the front and back sides of the door unencumbered by the mounting hardware, and said mounting hardware being removably attached to said top edge of the door frame so that if a left-handed door results when secured in the doorway, the mounting hardware can thereafter be detached from said top edge and then re-attached to said top edge of the door frame after the door frame is horizontally rotated one hundred eighty degrees, thus reconfiguring the door as a right-handed door but doing so without having to reconfigure the door pull's location on the sliding door; and said mounting hardware comprising an assembly for slidably attaching the door frame to the upper track.

2. The sliding door recited in claim 1, wherein the assembly for slidably attaching the door frame to the upper track comprises a roller assembly.

3. The sliding door recited in claim 2, wherein the roller assembly comprises a bracket and one or more rollers.

4. The system as recited in claim 3, wherein the mounting hardware further comprises one or more slow down blocks for regulating speed at which the door slides.

5. The sliding door recited in claim 1, wherein the mounting hardware further comprises one or more slow down blocks for regulating speed at which the door slides.

6. The sliding door recited in claim 1, wherein the mounting locations include a plurality of mounting holes for receiving the mounting hardware.

7. In an architectural design environment that includes one or more modular wall systems with one or more doorways, at least one of the doorways having an upper roller track affixed thereto, a sliding door that can be readily reconfigured after installation in a doorway so that the sliding door can be changed from a left-handed to a right-handed opening and vice versa, the sliding door comprising:

a door frame having first and second vertical members joined at the top by a first horizontal member and joined at the bottom by a second horizontal member, the first and second vertical members and the first horizontal member together defining a top edge of the door frame which includes a plurality of mounting locations on said top edge;

a door pull connected to one of said first or second vertical members so as to define either a left-handed or right-handed door when installed in said doorway;

mounting hardware comprised of at least two roller assemblies attached to said mounting locations on said top edge of the door frame in a manner that leaves the front and back sides of the door unencumbered by the roller assembly, and said roller assemblies being removably attached to said top edge of the door frame so that if a left-handed door results when secured in the doorway, the roller assemblies can thereafter be detached from said top edge and then re-attached to said top edge of the door frame after the door frame is vertically rotated one hundred eighty degrees so that the first and second vertical members and the second horizontal member together define a top edge of the door frame that includes a plurality of mounting locations on said top edge, thus reconfiguring the door as a right-handed door but doing so without having to reconfigure the door pull's location on the sliding door; and said roller assemblies each including one or more rollers for slidably attaching the door frame to the upper roller track.

8. The sliding door recited in claim 7, wherein each roller assembly comprises a bracket and one or more rollers.

9. The sliding door recited in claim 8, wherein the mounting hardware further comprises one or more slow down blocks for regulating speed at which the door slides.

10. The sliding door recited in claim 9, wherein the mounting locations include a plurality of mounting holes for receiving the mounting hardware.

11. The system as recited in claim 7, wherein the mounting hardware further comprises one or more slow down blocks for regulating speed at which the door slides.

12. In an architectural design environment that includes one or more modular wall systems with one or more doorways, a sliding door system that can be readily reconfigured after installation in a doorway so that the sliding door can be changed from a left-handed to a right-handed opening and vice versa, the sliding door system comprising:

an upper roller track attached at a header of a doorway in a manner so that a first portion of the roller track is positioned directly over the doorway, and the remaining portion of the roller track is positioned to the left or right of the doorway depending on whether the door is to be a left-handed or right-handed door, the attachment of said roller track being removable so that if a left-handed door results when secured in the doorway, the roller track can thereafter be detached and then re-attached to the header thus reconfiguring the roller track for a right-handed door if desired;

a door comprising a door frame having first and second vertical members joined at the top by a first horizontal member and joined at the bottom by a second horizontal member, the first and second vertical members and the first horizontal member together defining a top edge of the door frame which includes a plurality of mounting locations on said top edge;

a door pull connected to one of said first or second vertical members so as to define either a left-handed or right-handed door when installed in said doorway;

mounting hardware attached to said mounting locations on said top edge of the door frame in a manner that leaves the front and back sides of the door unencumbered by the mounting hardware, and said mounting hardware being removably attached to said top edge of the door frame so that if a left-handed door results when secured in the doorway, the mounting hardware can thereafter be detached from said top edge and then re-attached to top edge of the door frame after either (1) the door frame is horizontally rotated one hundred eighty degrees, or (2) the door frame is vertically rotated one hundred eighty degrees so that the first and second vertical members and the second horizontal member together define a top edge of the door frame that includes a plurality of mounting locations on said top edge, thus reconfiguring the door in either case as a right-handed door but doing so without having to reconfigure the door pull's location on the sliding door; and said mounting hardware comprising a roller assembly for slidably attaching the door frame to the upper roller track.

13. The sliding door system recited in claim 12, wherein the roller track is part of a roller track assembly further comprising a trim cap and one or more brackets for affixing the roller track assembly to the header of the doorway.

14. The sliding door system recited in claim 13, wherein the brackets of the roller track assembly are adjustable or removable.

15. The sliding door system recited in claim 12, wherein the assembly for slidably attaching the door frame to the upper track comprises a roller assembly.

16. The sliding door recited in claim 15, wherein the roller assembly comprises a bracket and one or more rollers.

17. The sliding door system recited in claim 16, wherein the brackets of the roller assembly assembly are adjustable or removable.

18. The sliding door recited in claim 17, wherein the mounting hardware further comprises one or more slow down blocks for regulating speed at which the door slides.

19. The sliding door recited in claim 12, wherein the mounting locations include a plurality of mounting holes for receiving the mounting hardware.

20. The system as recited in claim 12, wherein the mounting hardware further comprises one or more slow down blocks for regulating speed at which the door slides.

* * * * *